United States Patent [19]

Dorzok

[11] 4,152,820

[45] May 8, 1979

[54] METHOD OF EXPANDING SHOT TIP

[76] Inventor: LeRoy D. Dorzok, Rte. 1, 1511 Shalom Rd., Kewaskum, Wis. 53040

[21] Appl. No.: 876,455

[22] Filed: Feb. 9, 1978

[51] Int. Cl.[2] ..... B23Q 17/00

[52] U.S. Cl. ..... 29/404; 29/434; 29/445; 29/522 R; 29/156.5 A; 92/246; 164/113; 164/334

[58] Field of Search ..... 29/404, 434, 445, 522, 29/156.5; 92/245, 246; 164/113, 334

[56] References Cited

U.S. PATENT DOCUMENTS

| | | | |
|---|---|---|---|
| 1,020,836 | 3/1912 | Moore | 92/246 X |
| 2,059,728 | 11/1936 | Dick | 92/245 X |
| 2,654,646 | 10/1953 | Lidseen | 92/246 |
| 2,804,666 | 9/1957 | Saives | 164/113 |
| 2,932,865 | 4/1960 | Bauer | 164/113 |
| 3,008,202 | 11/1961 | Bauer | 164/314 X |
| 3,245,591 | 4/1966 | Kneusel | 92/246 X |
| 3,902,405 | 9/1975 | Costarella | 92/246 X |
| 3,994,208 | 11/1976 | Boyer | 92/246 |

FOREIGN PATENT DOCUMENTS

| | | | |
|---|---|---|---|
| 742182 | 11/1943 | Fed. Rep. of Germany | 164/314 |

*Primary Examiner*—Charlie T. Moon
*Attorney, Agent, or Firm*—Wheeler, Morsell, House & Fuller

[57] ABSTRACT

A method of expanding the shot tip in a die cast machine to maintain a sealing fit between the cold chamber and shot tip includes positioning a separate tool with an annular projecting beveled rim in the cold chamber and between the chamber and the movable die half and advancing the shot plunger to cause the beveled rim to project into and expand the periphery of the working end of the shot tip to provide a sealing fit. The expanding tool is used periodically in the casting cycle when required to maintain the desired fit of the shot tip with the cold chamber to prevent entry of metal in the space between the shot tip and the chamber which can cause galling and binding of the plunger in the chamber.

4 Claims, 7 Drawing Figures

METHOD OF EXPANDING SHOT TIP

BACKGROUND OF THE INVENTION

A major problem and inconvenience in die casting equipment is maintaining a working fit between the cold chamber and shot tip or plunger which pressures the molten metal into the die. Continued cycling of the shot tip in use results in wear of the shot tip which enables molten metal to enter the space between the shot tip and cold chamber. As the tip wears, the metal easily enters this area because of the high pressure to which the molten metal is subjected during the injection process. The most common method of maintaining the fit of the shot tip in the shot sleeve is to interrupt operation of the die casting machine and manually hammer the shot tip to expand the tip. This technique is very crude and can severely damage the tip and does not provide for uniform expansion of the full diameter of the shot tip, and thus the hammered and expanded tip does not maintain the desired sealing fit for more than a few cycles of the machine.

The Bauer Patent No. 2,932,865 discloses several arrangements to maintain the desired working fit of a shot plunger with the cold chamber. One technique disclosed in Bauer is to use a separate throw-away plunger which operates in advance of the shot tip. In other arrangements, the shot tip itself is provided with a special expandable rim which is deformed under pressure when in use. The techniques disclosed in Bauer have not been recognized in the trade as a satisfactory solution to the problem.

The German Patent No. 742,182 appears also to disclose a shot tip or plunger with an expandable rim, and thus is in the same category as Bauer.

SUMMARY OF INVENTION

The invention provides a method for expanding a shot tip to maintain the desired working clearance in the working chamber. No modifications are required to the conventional shot tip. The method utilizes the hydraulic force in a normal cycle of die cast operation to press the shot tip against an expanding tool which has a projecting annular rim which presses into the face of the shot tip and expands the peripheral surface of the shot tip to provide a tight sealing fit within the working chamber. The method of the invention provides uniform expansion to provide a smooth working fit in the chamber and, because of the uniformity in expansion afforded to the shot tip, the time when re-expanding the shot tip is required can be predicted. For instance, with certain equipment it can be empirically determined that the shot tip should be expanded in accordance with the method of this invention every 30 cycles.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
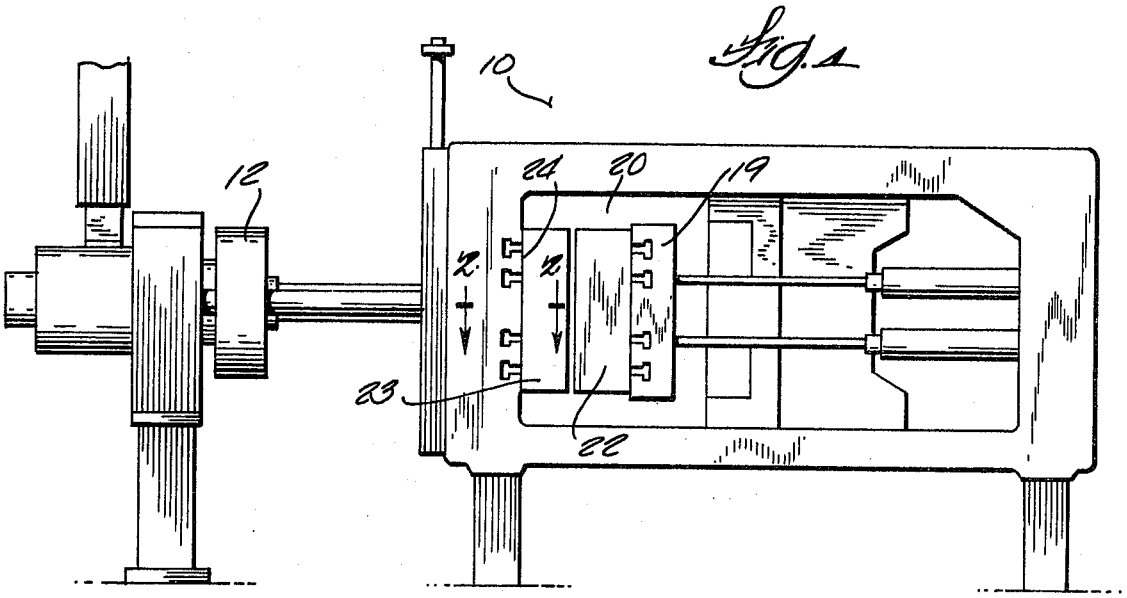
FIG. 1 is a side elevational view of conventional die cast apparatus which can utilize the method of the invention.
Figure 2:
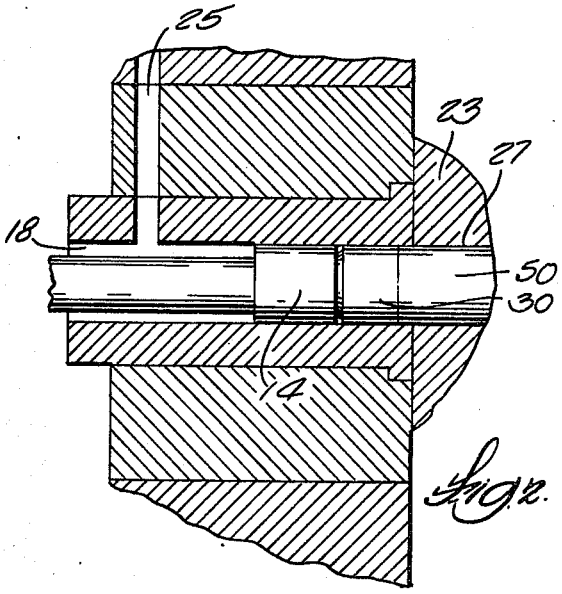
FIG. 2 is an enlarged sectional view along line 2—2 of FIG. 1 showing the shot tip and expanding tool in the cold chamber.

In the drawings, FIG. 1 shows a conventional die cast machine 10 which includes a hydraulic ram assembly 12 provided with a shot tip or shot plunger 14 (FIG. 2). Shot tips are conventionally formed from copper, copper beryllium alloys, brass or the like. The shot tip 14 is operative in a working chamber or cold chamber 18. Molten metal is introduced ahead of or in advance of the shot tip 14 through an opening 25. The die cast machine includes a reciprocatable die platten 19 which is movable in the space 20 to position a die 22 against a stationary die half 23 mounted on the face 24 for molten metal injection under pressure of the hydraulic ram assembly 12 and shot tip 14. As thus far described, the parts are conventional for a die cast machine.

Figure 5:
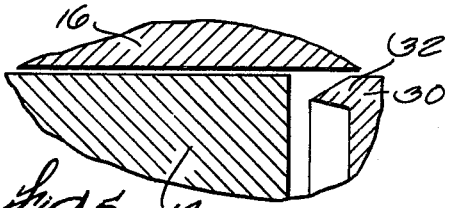
FIGS. 5, 6 and 7 show the sequence of steps of practicing the method of the invention.

In accordance with the method of the invention, a shot tip expander 30 is provided which can be machined from tool steel which is subsequently hardened to a hardness preferably greater than the shot tip. The expander 30 is cylindrical in shape and interfits in the chamber 18. The expander 30 is provided with an axially projecting tapered or beveled expanding rim 32 (FIG. 3) which is adapted to engage the face 15 of the shot tip 14 as shown in FIG. 5 and make circular line contact with the tip 14 concentric with the outside diameter of the cold chamber and inwardly of the periphery of the outer surface 17 of the shot tip. The rim 32 is tapered or beveled and wedge-shaped in cross-section so that when the shot tip is urged against the face 15, the body portion 44 (FIG. 6) between the contact circle and the outer periphery 17 of the shot tip is deformed and expanded to contact the surface 21 of the chamber 18 to seal the gap between the shot tip and the surface 21.

In performing the method of the invention, the expander 30 is backed by a biscuit 50 which can be the biscuit or slug from a previous cycle. The biscuit or slug is of an appropriate size and interfits in the sleeve and backs against the movable die 22 during a cycle, acting as a cushion to prevent possible damage to the movable die half 22.

Figure 6:
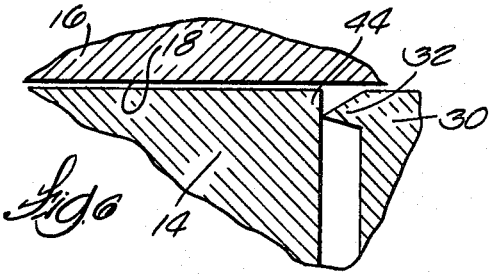
Figure 7:
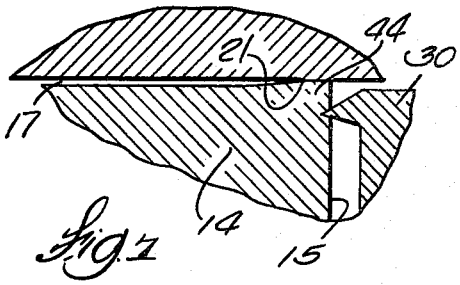

In practicing the method of the invention, after a known number of shot cycles, or after blowback around the shot tip has occurred due to wear of the shot tip, the expander tool 30 is positioned in the chamber 18 by normally pushing the tool 30 through the fill opening 27 in the stationary die half 23. A biscuit is then inserted through the fill opening 25 in the fixed or stationary die half 23. The machine is again actuated for a shot cycle and the power cylinder assembly 12 presses the shot tip 14 againat the expander 30, as shown in FIG. 6, with continued movement of the shot tip against the tip 32 causing the deformation shown in FIG. 7.

Figure 4:
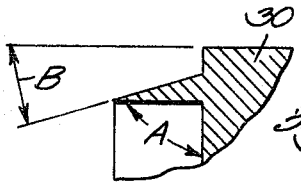
FIG. 4 is an enlarged fragmentary sectional view of a modified embodiment of the expanding tool.
Figure 3:
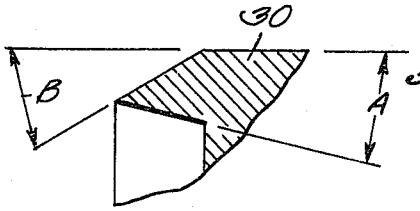
FIG. 3 is a fragmentary sectional view of the preferred form of expanding tool.

FIG. 3 shows the preferred form of rim 32 with an angle A or 10° and an angle B of 30°. An angle A of 90°, as shown in FIG. 4, has been employed and provides good penetration, but is not as stable and is more easily broken off. Angles A and B of 30° and 30° and 45° and 45° have been tested. Angles A and B of 45° and 45° did not work and angles with 30° and 30° worked slightly. The height of the rim or tooth H is desirably between 1/16"and 1/4", with optimum results found within that range.

What is claimed is:

1. A method of expanding the shot tip of a shot plunger in a die cast machine having fixed and movable die halves to maintain a seal between the shot tip and cold chamber comprising the steps of providing a tool sized to interfit in said chamber, said tool having an axially projecting annular beveled deforming rim, providing a back-up pad which interfits in said chamber in the space between said tool and the movable die half of said die cast machine and occupies said space to cause said deforming portion to be pressed into the adjacent face of said shot tip when said shot tip is advanced, and advancing said shot tip against said deforming tool to press said deforming rim into said shot tip to expand the periphery of said shot tip into a sealing fit with said cold chamber.

2. The method of claim 1 in which said expansion cycle is performed when required in between casting cycles.

3. The method of claim 1 wherein said beveled deforming ring has a height between 1/16" and 1/4".

4. The method of claim 3 wherein said beveled rim has inside and outside surfaces which merge at a circular juncture with said inside surface extending at diverging angle of generally 10° with respect to the axis of the tool and the outside surface converging toward said axis at an angle of 30° with respect to the tool axis.

* * * * *